US005186466A

United States Patent [19]

Mudd et al.

[11] Patent Number: 5,186,466

[45] Date of Patent: Feb. 16, 1993

[54] TOURNAMENT FISHING GAME APPARATUS

[76] Inventors: Michale F. Mudd; Kenneth W. Mudd; Kevin Mudd, all of Rt. 2, Box 225 Booker Rd., Springfield, Ky. 40069

[21] Appl. No.: 826,035

[22] Filed: Jan. 27, 1992

[51] Int. Cl.[5] ..... A63F 3/00

[52] U.S. Cl. ..... 273/244; 273/287

[58] Field of Search ..... 273/243, 244, 251, 252, 273/254, 255, 259, 277, 287, 457

[56] References Cited

U.S. PATENT DOCUMENTS

| | | | |
|---|---|---|---|
| 2,470,632 | 5/1949 | McLeod | 273/252 |
| 3,853,317 | 12/1974 | Braunhut | 273/457 X |
| 3,888,489 | 6/1975 | Kane | 273/244 |
| 3,921,981 | 11/1975 | Ashburn | 273/244 |
| 4,003,578 | 1/1977 | Jones | 273/244 |
| 4,241,924 | 12/1980 | Arcara | 273/277 |
| 4,290,608 | 9/1981 | Brown | 273/244 X |
| 5,090,735 | 2/1992 | Meaney et al. | 273/277 X |

FOREIGN PATENT DOCUMENTS

| | | | |
|---|---|---|---|
| 1405897 | 9/1975 | United Kingdom | 273/244 |
| 2123304 | 2/1984 | United Kingdom | 273/244 |

*Primary Examiner*—V. Millin
*Assistant Examiner*—William E. Stoll
*Attorney, Agent, or Firm*—Leon Gilden

[57] ABSTRACT

A tournament fishing game apparatus is arranged to accommodate a plurality of players, with the players directed along a game path formed with varying first and second spaces, wherein the first spaces direct a player to select a card from a pile of fish cards and credited with the catch indicated thereon, wherein landing upon a second space requires that player to select a card from a second pile of cards directing players to advance, retreat, effect a penalty, or effect a bonus relative to the player drawing the chance card. Culmination of the game is effected when all players have completed the game path with the largest catch of fish awarded by the fish cards presenting a winner.

2 Claims, 4 Drawing Sheets

TOURNAMENT FISHING GAME APPARATUS

BACKGROUND OF THE INVENTION

1. Field of the Invention

The field of invention relates to game apparatus, and more particularly pertains to a new and improved tournament fishing game apparatus wherein the same is directed to reflect tournament fishing conditions.

2. Description of the Prior Art

Various fishing game apparatus has been utilized in the prior art and is exemplified in the U.S. Pat. No. 4,032,144 to Moustakes wherein fish are drawn along tethered lines by manipulating strings securing the fish thereto.

U.S. Pat. No. 3,921,981 to Ashburn sets forth a bass tournament fishing game board in continuous periphery of spaces defining various obligations of a player to accommodate directions of the spaces.

U.S. Pat. No. 3,888,489 to Kane sets forth a fishing game relative to tournament fishing, as well as the U.S. Pat. No. 3,836,142 to Baker in a further example of a fishing game apparatus.

Accordingly, it may be appreciated that there continues to be a need for a new and improved tournament fishing game apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of fishing game apparatus now present in the prior art, the present invention provides a tournament fishing game apparatus wherein the same is directed for the players of a plurality of players to attempt to accommodate a greatest number of fish during traverse of a game path of the organization. As such, the general purpose of the present invention, which will be described subsequently in greater detail, is to provide a new and improved tournament fishing game apparatus which has all the advantages of the prior art fishing game apparatus and none of the disadvantages.

To attain this, the present invention provides a tournament fishing game apparatus arranged to accommodate a plurality of players, with the players directed along a game path formed with varying first and second spaces, wherein the first spaces direct a player to select a card from a pile of "fish cards" and credited with the catch indicated thereon, wherein landing upon a second space requires that player to select a card from a second pile of cards directing players to advance, retreat, effect a penalty, or effect a bonus relative to the player drawing the chance card. Culmination of the game is effected when all players have completed the game path with the largest catch of fish awarded by the fish cards presenting a winner.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tournament fishing game apparatus which has all the advantages of the prior art fishing game apparatus and none of the disadvantages.

It is another object of the present invention to provide a new and improved tournament fishing game apparatus which may be easily and efficiently manufactured and marketed.

It is a further object of the present invention to provide a new and improved tournament fishing game apparatus which is of a durable and reliable construction.

An even further object of the present invention is to provide a new and improved tournament fishing game apparatus which is susceptible of a low cost of manufacture with regard to both materials and labor, and which accordingly is then susceptible of low prices of sale to the consuming public, thereby making such tournament fishing game apparatus economically available to the buying public.

Still yet another object of the present invention is to provide a new and improved tournament fishing game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
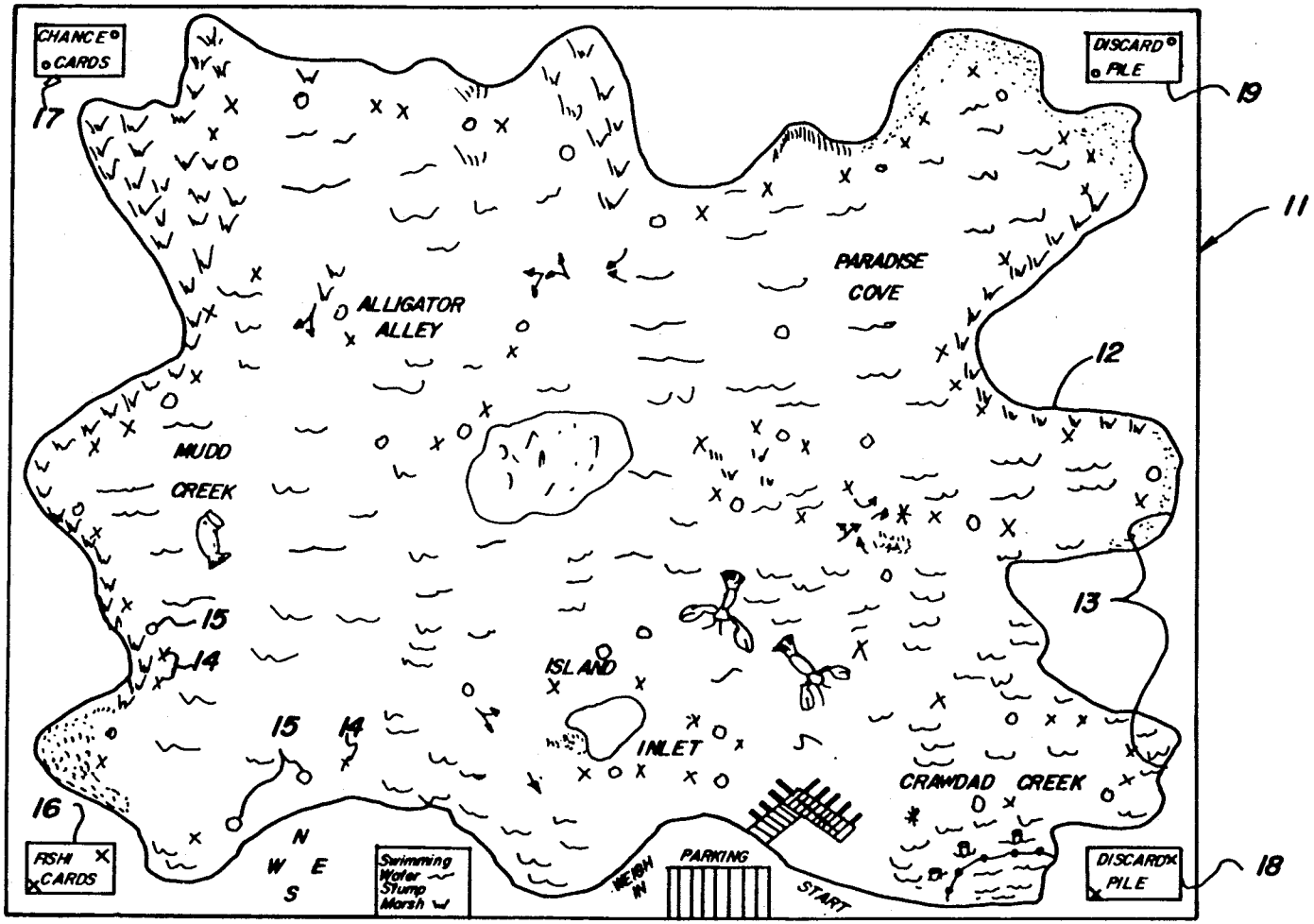
FIG. 1 is a top orthographic view of the game board of the invention.
Figure 2:
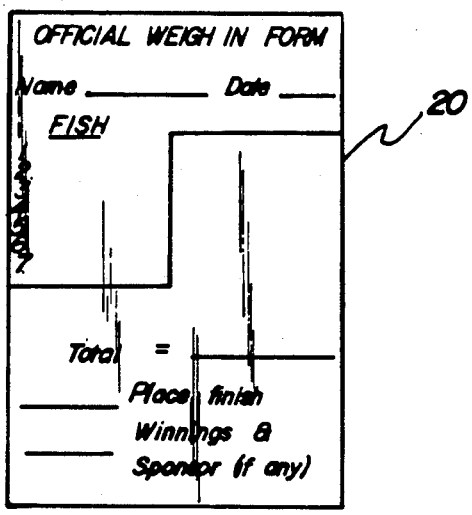
FIG. 2 is an orthographic view of the score card utilized by the invention.
Figure 3:
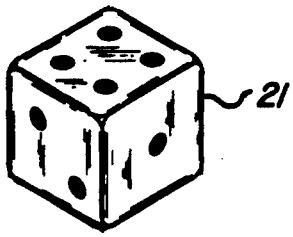
FIG. 3 is an isometric illustration of a dice member utilized by the invention.
Figure 4:
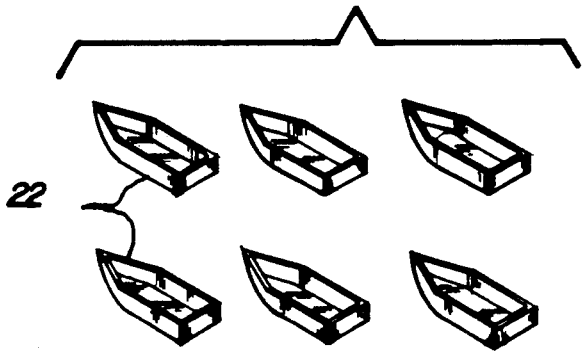
FIG. 4 is an isometric illustration of various tokens utilized by the invention.
Figure 5:
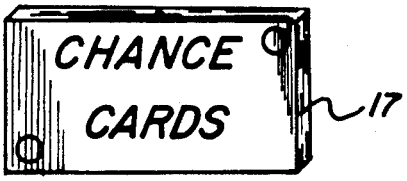
FIG. 5 is an isometric illustration of a second card type utilized by the invention.
Figure 6:
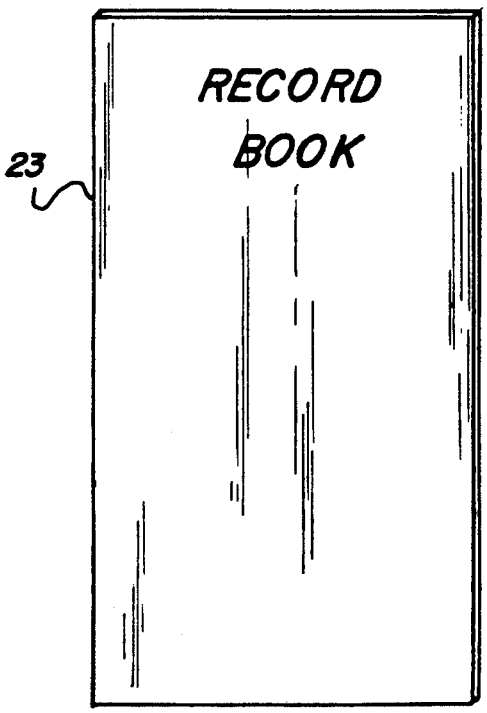
FIG. 6 is an isometric illustration of a scoring ledger book utilized by the invention.
Figure 7:
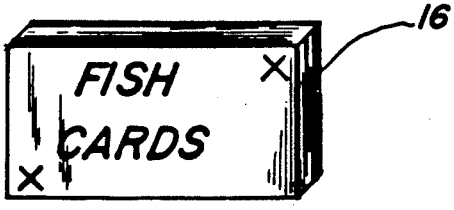
FIG. 7 is an isometric illustration of a first category of cards utilized.

With reference now to the drawings, and in particular to FIGS. 1 to 12 thereof, a new and improved tournament fishing game apparatus embodying the principles and concepts of the present invention and generally designated by the reference numerals 11–32 will be described.

More specifically, the tournament fishing game apparatus of the instant invention essentially comprises a board game to simulate a fishing tournament event. A game board 11 is provided to simulate a lake defining a lake perimeter 12, including a plurality of inlet coves 13, in a manner simulating an actual lake condition. A game path is defined about the game board surface 11 within the lake perimeter 12 by various first and second spaces 14 and 15 designated by respective "X" and "O" members. The game path is to be followed by a player, wherein the player may develop deviations from various path travel in traversing the path about the game board 11. A plurality of first cards 16 defined as fish cards are provided with a plurality of second cards 17 defined as chance cards, wherein upon discarding of such cards, the cards are deposited within respective first and second discard pile spaces 18 and 19. A game scoring card 20 is afforded each player to total the fish achieved during play of the game, with a dice member 21 utilized to direct a player a predetermined number of spaces along the game path. A token boat 22 of plurality of token boats is afforded each player, and the token boats may be of various colorations to distinguish players' tokens in use. A scoring ledger book 23 is provided to provide for historical compilation of past winners to keep a record of players and their rate of success in play of the game. Upon commencement of the game, each player will fill out with that player's name in an associated game score card. Competitive or to accommodate sportsmanship in play of the game and upon landing upon an occupied first space 16, a player will be penalized one pound of a fish total for each occurrence and may not fish upon that space. Fishing is permitted only upon landing upon an "X" space to permit drawing of a fish card 16. Subsequent to play of the game, the score cards are totalled to effect winning. Scoring is determined by the total poundage and ounces each player has accumulated during play of the game. The fish cards are delineated into various type of fish whereupon in that category, only large mouth bass, spotted bass, and small mouth bass will be counted. A total of seven bass per boat or team (should a plurality of players be joined) is permitted. Any player or team that has greater than the tournament limit of seven bass shall be disqualified. Upon reaching a seven fish limit, a player or team mate continues to catch fish, but must discard the smallest fish (defined by the first cards 16). Scoring will be maintained upon the score cards 21 by each player or team.

In the event of a tie, a "fish off" will be decided by a limited number of turns to be taken (to be decided beforehand) to declare a winner. Simulated monetary awards will be provided, wherein a first place finish with a seven fish limit will be awarded $150,000.00; a first place with less than seven fish will be awarded $100,000.00; non-first place finishers will be awarded with six fish, $75,000.00 to be counted to a career total; five fish, $50,000.00 to be counted towards a career total, four fish, $25,000.00 to be counted towards a career total; a three fish total will add $10,000.00 to a career total; and two fish or less will not be awarded any earnings. Each first place finish will gain one sponsor for a player for indication within the ledger book 23 for subsequent play.

In play, the players will roll the dice member 21 to determine who will proceed and in what progression and play will continue in a clockwise manner about the game board 11. The tokens must be moved the correct number of spaces and must follow the direction of arrows along the game path. In portions of the game path, there will be a choice as to which direction to move by the players. A player landing upon an "X" or first space may be permitted to draw a fish card, whereupon a player landing upon an "O" space or second space will be required to draw a chance card. The chance cards will effect arbitrary penalties, rewards, adding spaces, or deleting spaces from each player's traverse of the game path. The ledger book will be provided to keep track of the player's career winnings and earnings for subsequent play.

Figure 8:
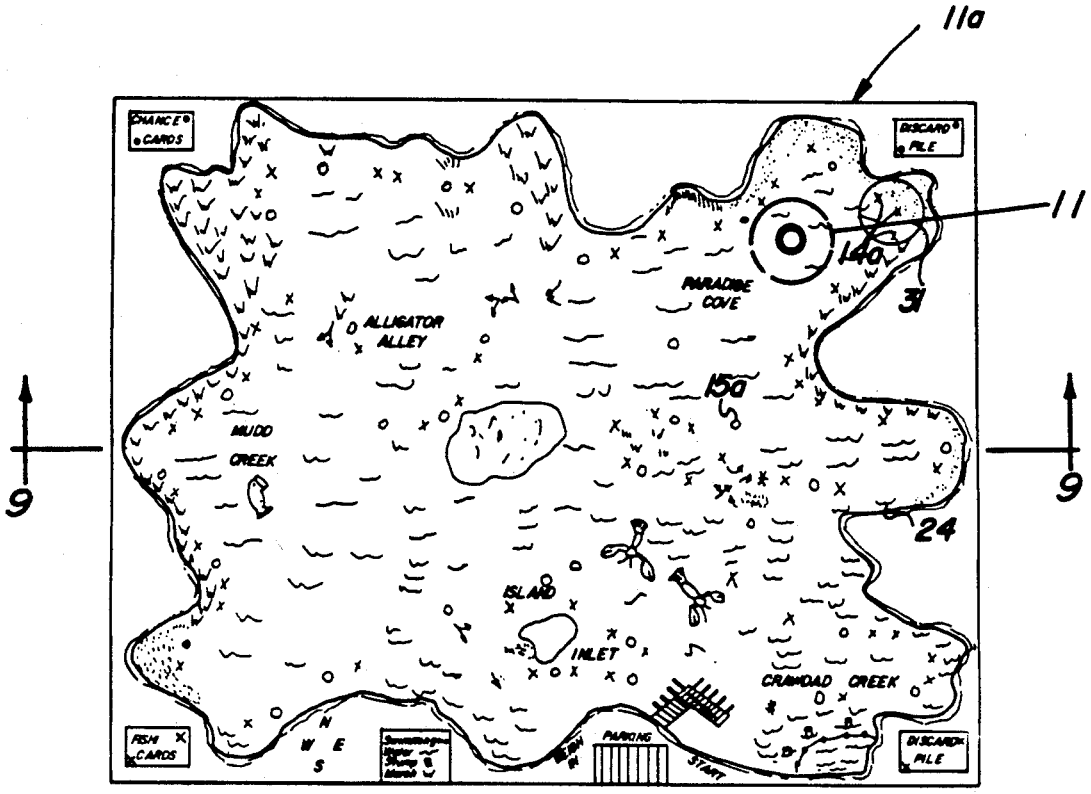
FIG. 8 is a top orthographic view of a modified game board of the invention.
Figure 9:
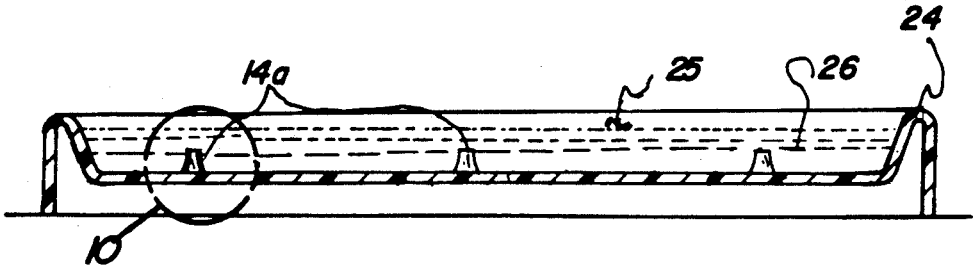
FIG. 9 is an orthographic view, taken along the lines 9—9 of FIG. 8 in the direction indicated by the arrows.
Figure 10:
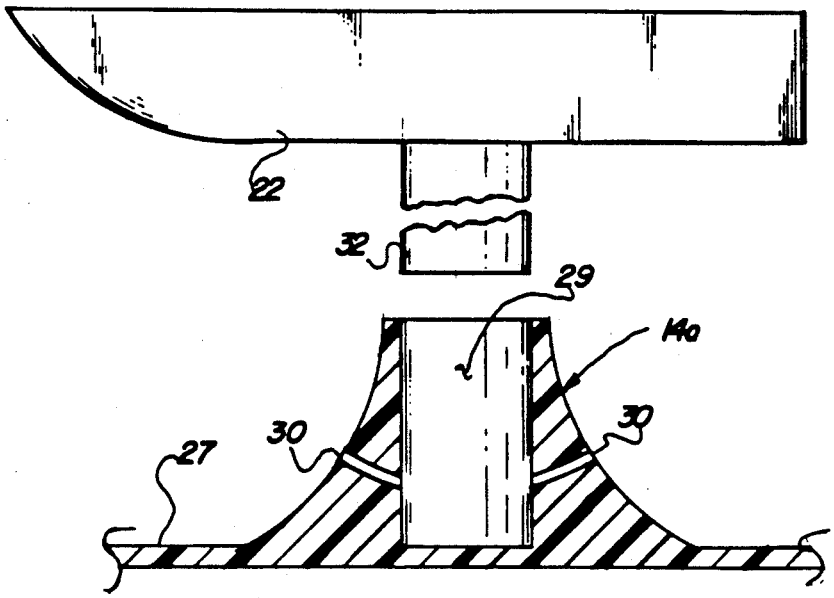
FIG. 10 is an orthographic cross-sectional illustration of a game space utilized by the modified game board as set forth in FIG. 8.
Figure 11:
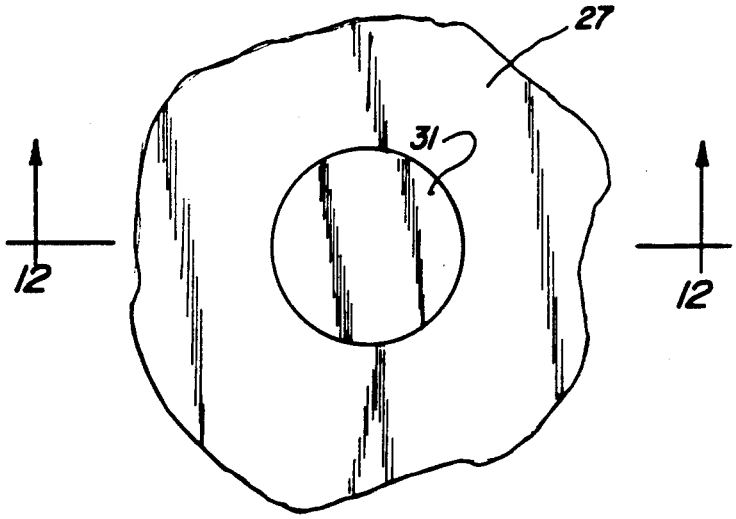
FIG. 11 is an orthographic view of section 11 and the drain plug of the invention.
Figure 12:
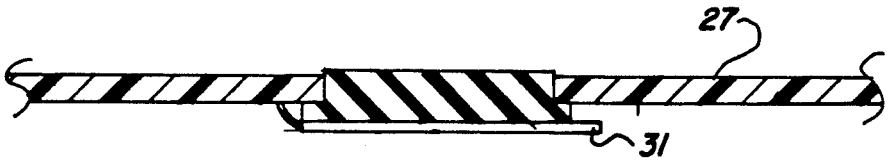
FIG. 12 is an orthographic cross-sectional illustration, taken along the lines 12—12 of FIG. 11 in the direction indicated by the arrows.

The FIG. 8 illustrates a modified game board 11*a* to include a perimeter wall 24 defined continuously about the perimeter of the simulated lake, wherein a fluid trough 25 is thusly defined that is filled with a fluid such as water 26. The fluid trough 25 includes a game board floor 27, with various arbitrarily coded spaces 14*a* defined as post members 14*a*, formed with a tubular socket 29 to receive a token cylindrical plug 32 fixedly and orthogonally mounted to a bottom surface or token floor of each token 22. The game board floor 27 is arranged to include a drain plug 31 removably mounted to the floor to permit the drainage of the water or fluid therefrom. The fluid is arranged to add realism into the game as part of the fishing environment, and wherein each of the tubular sockets 29 includes a plurality of drain ports 30 arranged to express excessive fluid on an associated cylindrical plug 32 when projected into a respective tubular socket 29 of each of the spaces 14*a* and 15*a*. The spaces 14*a* and 15*a* are constructed in a like manner, as illustrated in FIG. 10, to receive the token boats 22 in their traverse of the game path of the simulated lake, as illustrated in the FIG. 8 for example.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tournament fishing game apparatus, comprising, a game board, the game board including a simulated lake upon a top surface of the game board, wherein the simulated lake includes a circuitous lake perimeter, including a plurality of coves, and a circuitous game path defined within the simulated lake within the lake perimeter, wherein the game path includes first spaces and second spaces, and a plurality of first cards associated with the first spaces, and a plurality of second cards associated with the second spaces, the first cards and the second cards positioned upon the game board adjacent the lake perimeter exteriorly of the simulated lake, and a plurality of tokens, wherein a single token is awarded each player, and the token is directed along the game path, whereupon a player landing upon a first space is directed to follow directions on one of the first cards, and said player landing upon a second space is directed to follow directions on one of the second cards, and each player is provided a game score card to effect totalling of points directed by the first cards, and a dice member to direct players about the game path by chance, and the lake perimeter defines a wall extending upwardly of the game board, and a game board floor is defined within the wall, and a fluid trough is defined within the wall about the game board floor, and a fluid positioned within the fluid trough, and the first spaces and the second spaces are each defined as a post member extending upwardly relative to the game board floor, and each post member includes a cavity directed within the post member extending from an upper distal end of each post member, and each cavity including a plurality of drain ports directed from the cavity through the post member exteriorly thereof to permit projection of fluid through the drain ports, and each token including a token floor, and each token floor includes a token plug, and each plug is arranged for complementary reception within the cavity of each said post member.

2. An apparatus as set forth in claim 1 wherein the game board floor includes a drain plug removably mounted relative to the drain board floor to permit selective drainage of fluid from the fluid trough.

* * * * *